US005339143A

United States Patent [19]

Kunzmann

[11] Patent Number: 5,339,143

[45] Date of Patent: Aug. 16, 1994

[54] DEVELOPER UNIT CONDUCTIVE BRUSH

[75] Inventor: Brendan W. Kunzmann, Rochester, N.Y.

[73] Assignee: Xerox Corporation, Stramford, Conn.

[21] Appl. No.: 28,011

[22] Filed: Mar. 8, 1993

[51] Int. Cl.[5] ..... G03G 15/06
[52] U.S. Cl. ..... 355/259; 118/661
[58] Field of Search ..... 355/259, 261, 255; 118/651, 661, 654

[56] References Cited

U.S. PATENT DOCUMENTS

| | | | |
|---|---|---|---|
| 4,521,098 | 6/1985 | Hosoya et al. | 355/245 |
| 4,564,285 | 1/1986 | Yasuda et al. | 118/651 |
| 4,656,964 | 4/1987 | Kanno et al. | 118/651 X |
| 4,696,255 | 9/1987 | Yano et al. | 355/259 X |
| 4,989,044 | 1/1991 | Nishimura et al. | 355/251 |
| 5,017,967 | 5/1991 | Koga | 355/261 |
| 5,083,151 | 1/1992 | Honma | 118/651 X |
| 5,204,495 | 4/1993 | Floyd, Jr. et al. | 118/654 |

FOREIGN PATENT DOCUMENTS

| | | | |
|---|---|---|---|
| 0497601 | 8/1992 | European Pat. Off. . | |
| 0111564 | 7/1982 | Japan | 355/259 |
| 0105175 | 6/1983 | Japan | 355/259 |

*Primary Examiner*—A. T. Grimley
*Assistant Examiner*—Robert Beatty
*Attorney, Agent, or Firm*—H. Fleischer; J. E. Beck; R. Zibelli

[57] ABSTRACT

An apparatus which develops a latent image recorded on an image receiving member with developer material. A donor roll is positioned in a chamber of a housing having a supply of developer material. The donor roll transports a metered layer of developer material into contact with the latent image to develop the latent image. A conductive brush includes bristles having a diameter from about 6 to about 20 microns and contacts the metered layer of developer material on the developer roll. This substantially prevents the variation of triboelectric charge on the developer material on the donor roll so as to create a uniform charge level on the development material layer for development of the latent image.

20 Claims, 2 Drawing Sheets

DEVELOPER UNIT CONDUCTIVE BRUSH

Figures 1A, 1B:
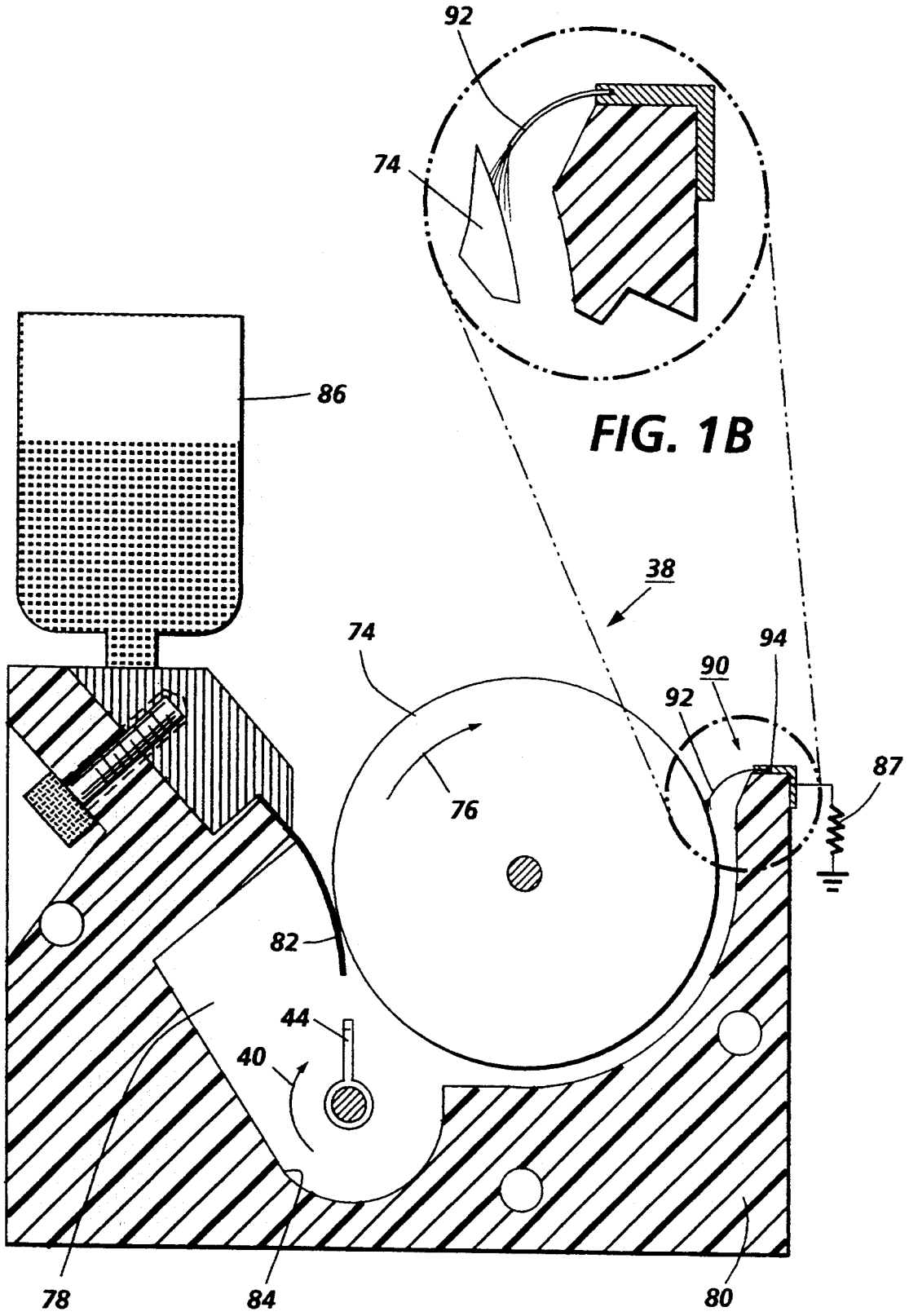

This invention relates generally to an electrophotographic printing machine, and more particularly, concerns a development apparatus in which a metered layer of development material is contacted to prevent triboelectric variations on toner particles, thereby creating a uniform charge level on the developer material.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms a powder image on the photoconductive member which is subsequently transferred to a copy sheet. The copy sheet is heated to permanently affix the developer material in image configuration.

In the foregoing type of printing machine, a development system is utilized to deposit developer material onto the electrostatic latent image recorded on the photoconductive surface. Generally, the developer material comprises toner particles adhering triboelectrically to coarser carrier granules. Typically, the toner particles are made from a thermal plastic material while the carrier granules are made from a ferromagnetic material. Alternatively, a single component developer material, e.g. magnetic toner particles or nonmagnetic color toner particles, may be employed. The developer material is attracted to a donor roll and advanced by the donor roll to the latent image so as to form a powder image on the photoconductive surface. Heretofore, there has generally been observed an image defect referred to as a ghost. The ghost is a variation in image developability caused by a prior developed image. When the developer material is advanced by the donor roll to the latent image on the photoconductive surface, the donor roll is reloaded with developer material that may be different in charge distribution. The difference shows up as a higher density area than the underdeveloped image area from the previous cycle. The image developed from the previous cycle is evident in the next cycle. Thus, it is highly desirable to be capable of eliminating ghosting on the photoconductive surface. Various types of developer units have been devised which may be relevant to the developer unit described herein. The following disclosures appear to contain relevant subject matter:

U.S. Pat. No. 4,989,044
Patentee: Nishimura et al.
Issued: Jan. 29, 1991

European Patent Application No. 92300801-5
Applicants: Goseki et al.
Filed: Jan. 30, 1992

U.S. Pat. No. 5,204,494
Applicants: Floyd et al.
Filed: Jun. 1, 1992

The disclosures of the above-identified patent and applications may be briefly summarized as follows:

U.S. Pat. No. 4,989,044 discloses a developing apparatus using one component developer. A developing sleeve carries the developer to the developing zone. The developing sleeve has an outer coating layer made of resin material in which electrically conductive fine particles are dispersed to stabilize the amount of triboelectric charge of the toner, thus preventing the production of a ghost image on the developed image.

European Patent Application No. 92300801-5 describes a developing apparatus for an electrostatic image on a photoreceptor drum using a movable developer sleeve triboelectrically charged with magnetic toner. The layer of developer is rendered uniform by the effect of a magnet and doctor blade. The developer sleeve has a surface coating of a resin material with which fine particles of graphite are dispersed. The material is selected to prevent both ghosting and fading under high temperature and high humidity conditions.

U.S. Pat. No. 5,204,495 discloses a donor roll position in the chamber of a housing storing a supply of developer material therein. The donor roll transports the material into contact with the latent image to develop the latent image. A rotating, elongated member fluidizes the developer material. As developer material is discharged from a storage container into the chamber of the developer housing, it exerts pressure on the fluidized developer material to move the developer material from one end of the housing to the other end thereof. An electrical bias is applied between the elongated member and the donor roll so as to attract developer material to the donor roll. The free end of a metering and charging blade is resiliently urged into contact with the donor roll to regulate the quantity of developer material on the donor roll and to provide a charge therefor. A rotating and translating brush gently disturbs the metered layer of developer material on the donor roll so as to prevent the accumulation of developer material agglomerates on the donor roll creating a stable, uniform layer of developer material for developing the latent image therewith.

Pursuant to the features of the present invention, there is provided an apparatus for developing a latent image recorded on an image receiving member in a development zone. The apparatus includes a housing defining a chamber storing a supply of developer material therein. Means, disposed at least partially in the chamber of the housing, transport developer material to the development zone to develop the latent image recorded on the image receiving member. A brush comprising a multiplicity of conductive bristles is provided for contacting the layer of developer material on the transporting means. This minimizes triboelectric charge variations in developer material on the transporting means creating a substantially uniform charge level in developer material thereon.

In accordance with another aspect of the present invention, there is provided an electrophotographic printing machine of the type having an electrostatic latent image recorded on a photoconductive member in a development zone. The improvement includes a housing defining a chamber storing a supply of developer material therein. Means, disposed at least partially in the chamber of the housing, transport developer material to the development zone to develop the latent image recorded on the photoconductive member. A brush comprising a multiplicity of conductive bristles is provided for contacting the layer of developer material on the transporting means. This minimizes triboelectric charge variations in developer material on the transporting means creating a substantially uniform charge level in developer material thereon.

Figure 2:
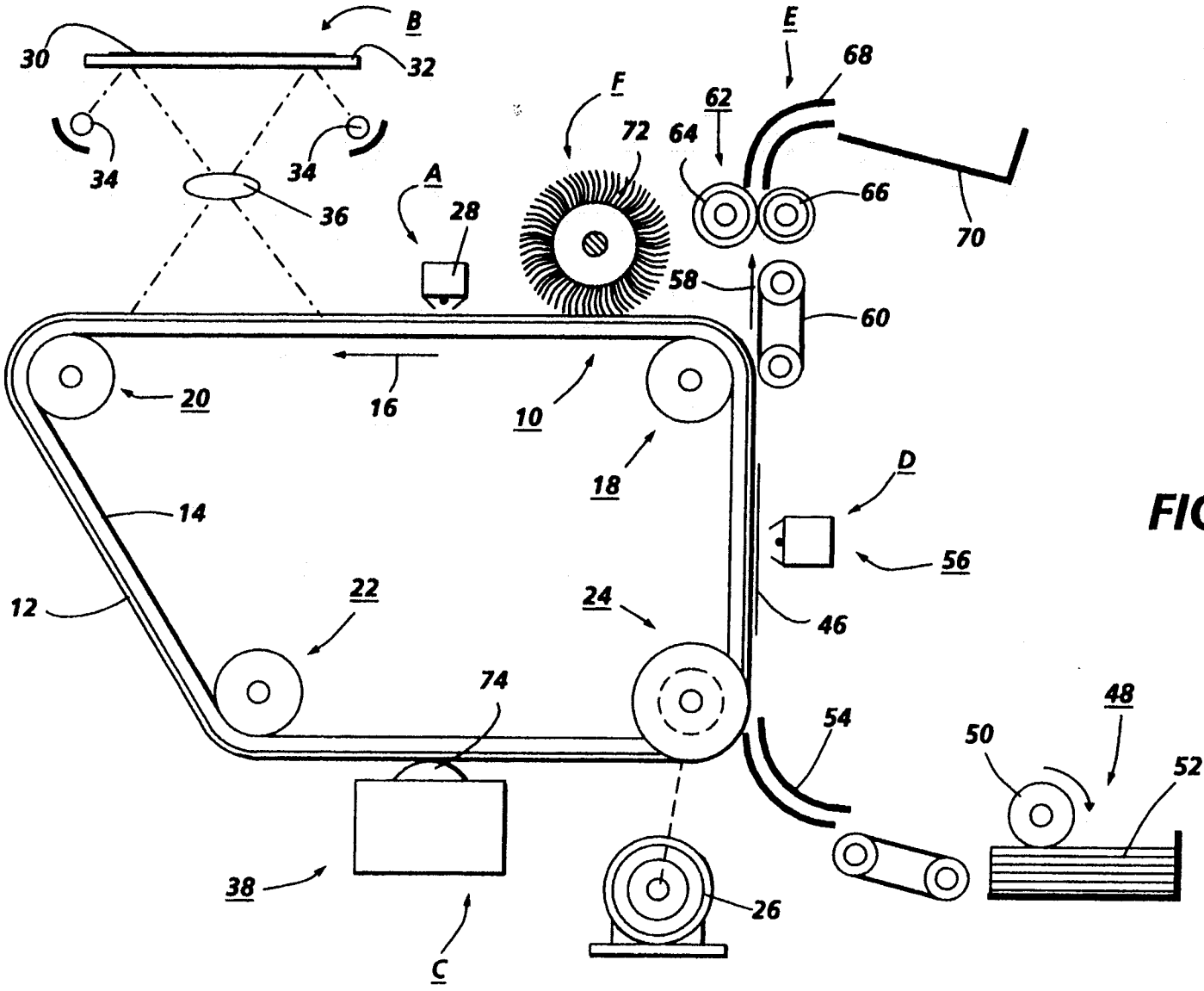

Other aspects of the present invention will become apparent as the following description proceeds and upon reference to the drawings, in which:

FIGS. 1A and 1B are schematic elevational views showing a development apparatus of the present invention; and FIG. 2 is a schematic elevational view depicting an electrophotographic printing machine incorporating the FIG. 1 development apparatus therein.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. FIG. 2 schematically depicts the various elements of an illustrative electrophotographic printing machine incorporating the development apparatus of the present invention therein. It will become evident from the following discussion that the development apparatus is equally well suited for use in a wide variety of printing machines and is not necessarily limited in its application to the particular embodiment depicted herein.

Inasmuch as the various art of electrostatic printing is well known, the various processing stations employed in the FIG. 2 printing machine will be shown hereinafter and their operation described briefly with reference thereto.

Turning now to FIG. 2, the electrophotographic printing machine employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20 and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

One skilled in the art will appreciate that a Raster Input Scanner (RIS) and a Raster Output Scanner (ROS) may be used instead of the light lens system heretofore described. The RIS contains document illumination lamps, optics, a mechanical scanning mechanism and photosensing elements such as charged couple device (CCD) arrays. The RIS captures the entire image from the original document and converts it to a series of raster scan lines. These raster scan lines are outputed from the RIS and function as the input to the ROS. The ROS performs the function of creating the output copy of the image and lays out the image in a series of horizontal lines with each line having a specific number of pixels per inch. These lines illuminate the charged portion of the photoconductive surface to selectively discharge the charge thereon. An exemplary ROS has lasers with rotating polygon mirror blocks, solid state modulator bars and mirrors. Still another type of exposure system would merely utilize a ROS with the ROS being controlled by the output from an electronic subsystem (ESS) which prepares and manages the image data flow between a computer and the ROS. The ESS is the control electronics for the ROS and may be a self-contained, dedicated minicomputer.

At development station C, a developer unit, indicated generally by the reference numeral 38, transports a single component developer material of toner particles into contact with the electrostatic latent image recorded on photoconductive surface 12. Toner particles are attracted to the electrostatic latent image forming a toner powder image on photoconductive surface 12 of belt 10 so as to develop the electrostatic latent image. The detailed structure of developer unit 38 will be described hereinafter with reference to FIG. 1.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the uppermost sheet of a stack of sheets 52. Feed roll 50 rotates to advance the uppermost sheet from stack 50 into sheet chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Referring now to FIGS. 1A and 1B, the detailed structure of developer unit 38 is shown thereat. The developer unit includes a donor roll 74. Donor roll 74 may be bare metal such as aluminum. Alternatively, the donor roll may be a metal roller coated with a thick material. By way of example, a polytetrafluoroethylene based resin, such as Teflon, a trademark of the DuPont Corporation, or a polyvinylidene fluoride based resin, such as Kynar, a trademark of the Pennwalt Corporation, may be used to coat the metal roller. This coating acts to assist in charging the particles adhering to the surface thereof. Still another type of donor roll may be made from stainless steel plated by a catalytic generation process and impregnated with Teflon. The surface of the donor roll is roughened from a fraction of a micron to several microns, peak to peak. Donor roll 74 is coupled to a motor which rotates donor roll 74 in the direction of arrow 76. Donor roll 74 is positioned, at least partially, in chamber 78 of housing 80. An elongated toner agitating member, indicated generally by the reference numeral 44, agitates the toner particles. Agitated toner particles seek their own level under the influence of gravity. Inasmuch as new toner particles are being discharged from container 86 into one end of the chamber 78 of housing 80, the force exerted on the agitated toner particles by the new toner particles being added at that end moves the toner particles from that end of housing 80 to the other end thereof. Elongated member 44 is located in chamber 78 closely adjacent to an arcuate portion 84 of housing 80. New toner particles are discharged into one end of chamber 78 from container 86. As elongated member 44 rotates in the direction of arrow 40, toner particles are agitated. A motor (not shown) rotates elongated member 44 at about 300 revolutions per minute. The force exerted on the agitated toner particles by the new toner particles being discharged into chamber 78 advances the agitated toner particles from the end of the chamber in which the new toner particles have been discharged to the other end thereof. The agitated toner particles being moved are attracted to donor roller 74. Elongated member 44 is made from a material, such as aluminum. Elongated member 44 is spaced from donor roller 74 to define a gap therebetween. This gap may range from about 0.05 centimeter to about 0.15 centimeter. Donor roller 74 rotates in the direction of arrow 76 to move the toner particles attracted thereto into contact with the electrostatic latent image recorded on photoconductive surface 12 of belt 10. As donor roll 74 rotates in the direction of arrow 76, metering blade 82 has the region of the free end thereof resiliently urged into contact with donor roll 74. Metering blade 82 may be made from a metal, silicon rubber, or plastic material. By way of example, metering blade 82 may be made from steel phosphor bronze and ranges from about 0.025 millimeter to about 0.25 millimeter in thickness, being a maximum of 25 millimeters wide. The free end of metering blade 82 extends beyond the tangential contact point with donor roll 74 by about 4 millimeters or less. Metering blade 82 is maintained in contact with donor roll 74 at a pressure ranging from about 10 grams per centimeter to about 250 grams per centimeter. The layer of toner particles adhering to donor roll 74 ranges from about 0.1 milligram per centimeter square to about 2 milligirams per centimeter square of roll surface. In addition to regulating the quantity of toner particles being advanced by donor roll 74, metering blade 82 charges the toner particles to about 20 microcoulombs/gram.

The brush 90 is shown with an electrically conductive support 94 which is connected to ground potential through a high resistive element 87. By way of example, high resistive element 87 is a 2 megohm resistor. The brush 90 has a multiplicity of conductive bristles 92 extending outwardly therefrom. The bristles 92 are fabricated from a good electrically conductive material such as carbon fibers. The bristles are comprised of a bundle of conductive fibers to increase the mechanical strength of the bristles. The ends of the bristles 92 are frayed so that the individual fibers in the bundle contact the layer of development material on donor roll 74. Preferably, the diameter of each carbon fiber is between 6 and 20 microns, and the length of each fiber is 12 millimeters. The area density of each bristle is 20 fibers/millimeter$^2$. The brush 90, which is mounted by suitable means, such as bolts, to a permanent part of housing 80, has a length which is equal to the width of donor roll 74. As the donor roll 74 rotates past the development nip in the direction of arrow 76, bristles 92 penetrate the layer of development material on donor roll 74 and contact as many toner particles as possible to reduce the variation of triboelectric charge on the toner particles by allowing a charge transfer between the toner particles on the donor roll surface. In this way, a stable, uniform toner layer substantially devoid of variation in triboelectric charge on the toner particles, which can affect the developability of the latent image on the photoreceptor, is achieved.

In recapitulation, it is clear that the apparatus of the present invention includes a donor roll having a metered layer of developer material thereon. A conductive brush has the bristles thereon in contact with the metered layer of developer material. The contacting of the conductive brush bristles penetrating the metered layer of developer material prevents the variation in triboelectric charge on the toner particles. This creates a more stable, uniform developer material for development.

It is, therefore, evident that there has been provided in accordance with the present invention, a developer unit that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for developing a latent image recorded on an image receiving member in a development zone, including:

a housing defining a chamber storing a supply of developer material therein;

means, disposed at least partially in the chamber of said housing, for transporting developer material to the development zone to develop the latent image recorded on the image receiving member, said transporting means comprising a donor roll for transporting the developer material, and means for metering the developer material being advanced by said donor roll to form a metered layer of developer material on said donor roll; and a brush comprising a multiplicity of conductive bristles contacting the layer of the developer material on said donor roll to minimize triboelectric charge variations in the developer material on said donor roll creating a substantially uniform charge level in the developer material thereon, said brush comprising an electrically conductive support having said bristles extending outwardly therefrom with said bristles having free ends contacting the metered layer of developer material being transported by said donor roll, and means for electrically grounding said support, each of said bristles ranges from about 6 to about 20 microns in diameter.

2. An apparatus according to claim 1, wherein said metering means includes a blade having a free end thereof resiliently urged into engagement with said donor roll.

3. An apparatus according to claim 2, further including means for agitating developer material disposed in the chamber of said housing.

4. An apparatus according to claim 3, wherein said agitating means includes a rotatably mounted elongated member disposed interiorly of the chamber of said housing.

5. An apparatus according to claim 1, wherein a multiplicity of said bristles form a bundle.

6. An apparatus according to claim 1, wherein the free ends of said bristles are frayed.

7. An apparatus according to claim 1, wherein each of said bristles is preferably about 12 millimeters in length.

8. An apparatus according to claim 7, wherein each of said bristles is preferably made from a carbon material.

9. An apparatus according to claim 1, wherein said brush comprises a surface density preferably of about 20 bristles/millimeter$^2$.

10. An electrostatic printing machine of the type having an electrostatic latent image recorded on a photoconductive member with the latent image being developed in a development zone, wherein the improvement includes:

a housing defining a chamber storing a supply of developer material therein;

means, disposed at least partially in the chamber of said housing, for transporting developer material to the development zone to develop the latent image recorded on the image receiving member, said transporting means comprising a donor roll for transporting the developer material, and means for metering the developer material being advanced by said donor roll to form a metered layer of developer material on said donor roll; and a brush comprising a multiplicity of conductive bristles contacting the layer of the developer material on said donor roll to minimize triboelectric charge variations in the developer material on said donor roll creating a substantially uniform charge level in the developer material thereon, said brush comprising an electrically conductive support having said bristles extending outwardly therefrom with said bristles having free ends contacting the metered layer of the developer material being transported by said donor roll, and means for electrically grounding said support, each of said bristles ranges from about 6 to 20 microns in diameter.

11. A printing machine according to claim 10, wherein said metering means includes a blade having a free end thereof resiliently urged into engagement with said donor roll.

12. A printing machine according to claim 11 further including means for agitating developer material disposed in the chamber of said housing.

13. A printing machine according to claim 12 wherein said agitating means includes a rotatably mounted elongated member disposed interiorly of the chamber of said housing.

14. A printing machine according to claim 10, wherein a multiplicity of said bristles form a bundle.

15. A printing machine according to claim 10, wherein the free ends of said bristles are frayed.

16. A printing machine according to claim 10, wherein each of said bristles is preferably about 12 millimeters in length.

17. A printing machine according to claim 16, wherein each of said bristles is preferably made from a carbon material.

18. A printing machine according to claim 10, wherein said said brush comprises a surface density preferably of about 20 bristles/millimeter$^2$.

19. An apparatus for developing a latent image recorded on an image receiving member in a development zone, including:

a housing defining a chamber storing a supply of developer material therein;

means, disposing at least partially in the chamber of said housing, for transporting developer material to the development zone to develop the latent image recorded on the image receiving member; and a brush comprising a multiplicity of conductive bristles contacting the developer material on said transporting means to minimize triboelectric charge variations in the developer material on said transporting means creating a substantially uniform charge level in the developer material thereon, each of said bristles ranging from about 6 to 20 microns in diameter.

20. An electrostatic printing machine of the type having an electrostatic latent image recorded on a photoconductive member with the latent image being developed in a development zone, wherein the improvement includes:

a housing defining a chamber storing a supply of developer material;

means, disposed at least partially in the chamber of said housing, for transporting developer material to the development zone to develop the latent image recorded on the image receiving member; and a brush comprising a multiplicity of conductive bristles contacting the developer material on said transporting means to minimize triboelectric charge variations in the developer material on said transporting means creating a substantially uniform charge level in the developer material thereon, each of said bristles ranging from about 6 to about 20 microns in diameter.

* * * * *